United States Patent [19]

Davis et al.

[11] 4,045,005

[45] Aug. 30, 1977

[54] BLENDING DEVICE

[75] Inventors: Dwight E. Davis, Escondido; Stephen J. Foster, San Diego, both of Calif.

[73] Assignee: General Atomic Company, San Diego, Calif.

[21] Appl. No.: 532,314

[22] Filed: Dec. 13, 1974

[51] Int. Cl.[2] ..... B01F 13/02

[52] U.S. Cl. ..... 259/36; 259/DIG. 17

[58] Field of Search ..... 259/36, 60, 151, DIG. 17; 222/195

[56] References Cited

U.S. PATENT DOCUMENTS

| | | | |
|---|---|---|---|
| 2,733,840 | 2/1956 | Kolks | 222/195 |
| 2,884,230 | 4/1959 | Pyle | 222/195 X |
| 3,125,256 | 3/1964 | Kokeisl | 222/195 |
| 3,179,378 | 4/1965 | Zenz | 259/151 X |
| 3,345,181 | 10/1967 | Smith | 259/DIG. 17 |

FOREIGN PATENT DOCUMENTS

| | | | |
|---|---|---|---|
| 1,129,043 | 5/1962 | Germany | 259/DIG. 17 |
| 834,455 | 5/1960 | United Kingdom | 259/DIG. 17 |

*Primary Examiner*—Billy J. Wilhite
*Assistant Examiner*—Alan Cantor
*Attorney, Agent, or Firm*—Fitch, Even, Tabin & Luedeka

[57] ABSTRACT

A blending device is described for providing a uniform mix of particulate material. A pressurized fluid is conducted into a plenum surrounding a mixing chamber proximate the lower end thereof. An annular slit in the wall between the plenum and the mixing chamber allows the pressurized fluid to discharge through the slit for agitating particulate material contained in the mixing chamber.

9 Claims, 7 Drawing Figures

BLENDING DEVICE

This invention relates to blending devices and, more particularly, to an improved blending device for providing a uniform mix of particulate material and which is especially useful in connection with particulate materials comprised of components with large variations in particle density and size.

The need for uniformly mixing particulate material arises in a number of industrial situations. One convenient and successful way of accomplishing such mixing is in a mixing chamber into which compressed air is injected to provide a fluidized bed of the particulate material in the mixing chamber. The injection of the compressed air may be intermittent or continuous to provide sufficient agitation of the fluidized bed to result in a homogeneous mixture.

For some types of materials, prior art blending devices, including those of the compressed air fluidized bed type described above, have not been particularly successful wherein the components of the particulate material have large variations in particle density and size. For example, in the manufacture of certain types of nuclear fuel rods, two or more components, such as thorium, uranium, etc., are mixed, usually in very small amounts (e.g. 25 grams). The difficulty of blending such materials is directly proportional to the number of components and their relative percentages in the ultimate mixture. Typically, such mixtures include the nuclear fuel components and a filler material so shim and all of these have widely variant densities and sizes. In the manufacture of nuclear fuel rods, a homogeneous mixture of the particles is important to assure a uniform power density and to avoid localized areas of excessive heating within a given fuel element.

It is an object of the present invention to provide an improved blending device.

Another object of the invention is to provide a blending device capable of achieving a homogeneous blend of components of particulate material in which large variations in particle density and size exist.

Another object of the invention is to provide a blending device capable of producing substantially homogeneous particle mixtures for nuclear fuel rods.

Other objects of the invention will become apparent to those skilled in the art from the following description, taken in connection with the accompanying drawings wherein.

Figure 1:
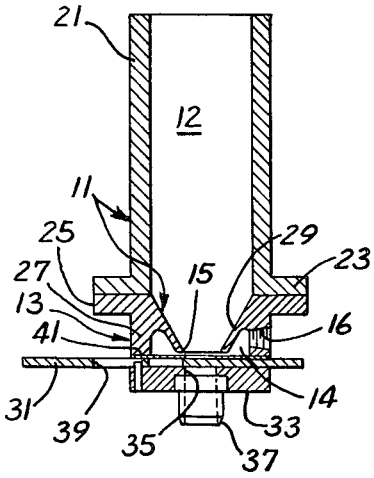
FIG. 1 is a full section side view of a blending device constructed in accordance with the invention.

Very generally, the blending device of the invention comprises wall means 11 defining a mixing chamber 12 and means 13 defining a plenum 14 surrounding the mixing chamber at the lower end thereof. An annular slit 15 is provided in the wall means 11 communicating between the plenum and the mixing chamber. Means 16 are provided for conducting pressurized fluid to the plenum to discharge through the slit for agitating particulate material contained in the mixing chamber.

Referring in more detail to the drawings, the device as illustrated in FIG. 1 includes an upper tubular section 21 which is open at the top and which is provided with a mounting flange 23 surrounding the lower periphery thereof. The upper section 21 is suitably mounted by means, not shown, such as bolts, through the flange 23 to a flange 25 which extends outwardly from a vertical cylindrical wall 27. The wall 27 is approximately aligned with the wall 21.

A frustoconical lower section 29 is formed integral with the wall 27 and the flange 25 and defines the lower tapered portion of the chamber 12. A slide plate 31 extends transversely at the bottom of the frustoconical section 29 and is perpendicular with the axis of the section 29 and the tube 21.

The plate 31, together with the cylindrical wall 27 and the frustoconical section 29 forms the means 13 which define the plenum 14. The lower periphery of the frustoconical section 29 terminates a short distance above the plate 31 so as to define the annular or 360° slot or slit 15.

A base 33 is provided for the plate 31 and an opening 35 is provided in the base in which a spout 37 is threaded. The plate 31 is provided with an opening 39 therein and, when the plate is moved slidably to cause the opening 39 to register with the open lower end of the frustoconical section 29, the contents of the chamber 12 may fall through the opening and through the opening 35 and the spout 37. An injection mold may be positioned below the spout 37 to receive the contents of the chamber 12.

For the purpose of providing the blending action in the blending device illustrated, an opening 16 is provided in the cylindrical wall 27. A suitable source of pressurized fluid, not shown, is connected to the opening to pressurize the interior of the plenum 14. When thus pressurized, the fluid discharges through the 360° annular slit 15 into the mixing chamber 12. This fluid, which enters the bottom of the mixing chamber from all directions, will eventually flow up into and out of the chamber 12 causing agitation of particles therein. The size of the slit 15 is made to be less than half the diameter of the smallest particle to avoid jamming of the particles in the slot. As an alternative, a porous material may be provided in the slit to act as a screen, in which case the slit may be made wider.

To minimize the possibility of particle breaking or jamming and to decrease fluid leakage through the slide valve or plate 31, a thin metal plate 41 is provided between the plate 31 and the lower edge of the cylindrical wall 27. This plate, of course, is provided with a suitable opening therein registering with the open lower end of the frustoconical section 29.

Figure 2:
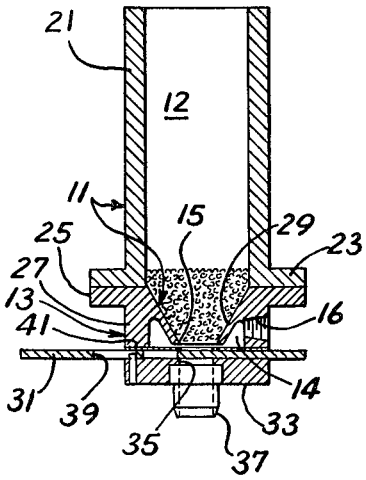
FIGS. 2 through 5 are views similar to FIG. 1 illustrating sequential steps in the operation of the blending device of FIG. 1.

In operating the device of the invention, the slide plate 31 is moved to close the chamber 12 and the plenum 14 is depressurized. The particulate material is then loaded into the chamber 12 from the top as shown in FIG. 2. In FIG. 2, three different particle sizes and densities are indicated at the three distinguishable levels, representing, for example, three nuclear fuel rod components.

Figure 3:
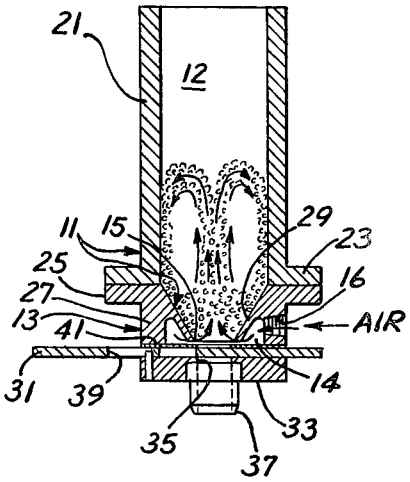

In FIG. 3, the mixing action is shown which occurs upon pressurization of the plenum 14 through the port 16. The airflow pattern is inward through the 360° slit which causes a fountain-like spouting action in the bed of particles. The height of the spouting bed of particles is adjusted by varying the pressure and, as will be described, a pulsing action may also be used.

Figure 4:
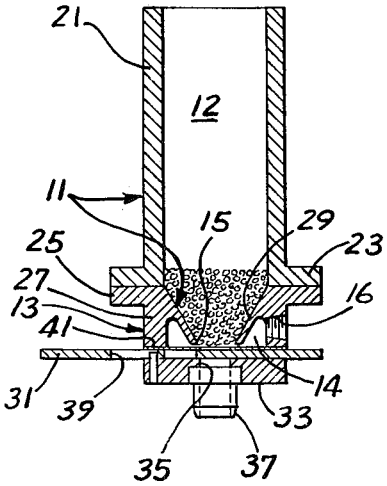
Figure 5:
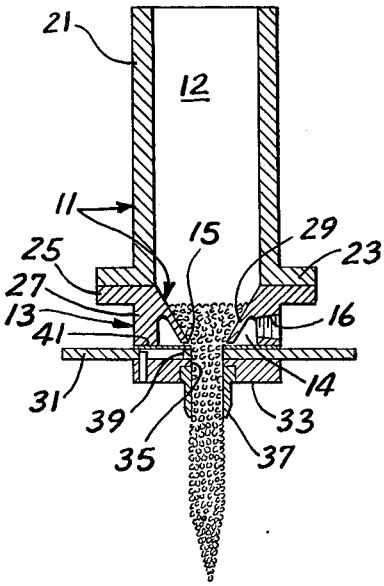

Once the pressurization has stopped, the particles fall once again to the lower end of the chamber 12, but, as may be seen in FIG. 4, are mixed in a homogeneous blend. After this, the slide plate 31 may be moved to cause registration of the opening 39 with the open lower end of the frustoconical section 29. As may be seen in FIG. 5, the particles are then dumped out of the chamber through the spout 37. A suitable injection mold may be provided for receiving the particles and for molding a fuel rod, as is known in the art.

Tests have shown that it is possible to operate the device of the invention in such a way as to provide extremely uniform mixes. For example, using a blend of fissile, fertile and shim particles totaling about 19 grams and varying in density from about 2 to 3 g/cc, it was possible to obtain a uniformity in mix within a standard deviation of plus or minus 2 percent. Ten air pulses of 0.25 second duration at a flow rate of 1.9 cubic feet per minute were used in such tests. The blending chamber was about 1½ inches diameter and about 3½ inches long. Decreases in the flow rate of up to 20% did not significantly alter the performance of the apparatus. Increases in the number of pulses and/or the pulse time have very little effect, whereas a decrease causes a significant deterioration in the results.

Figure 6:
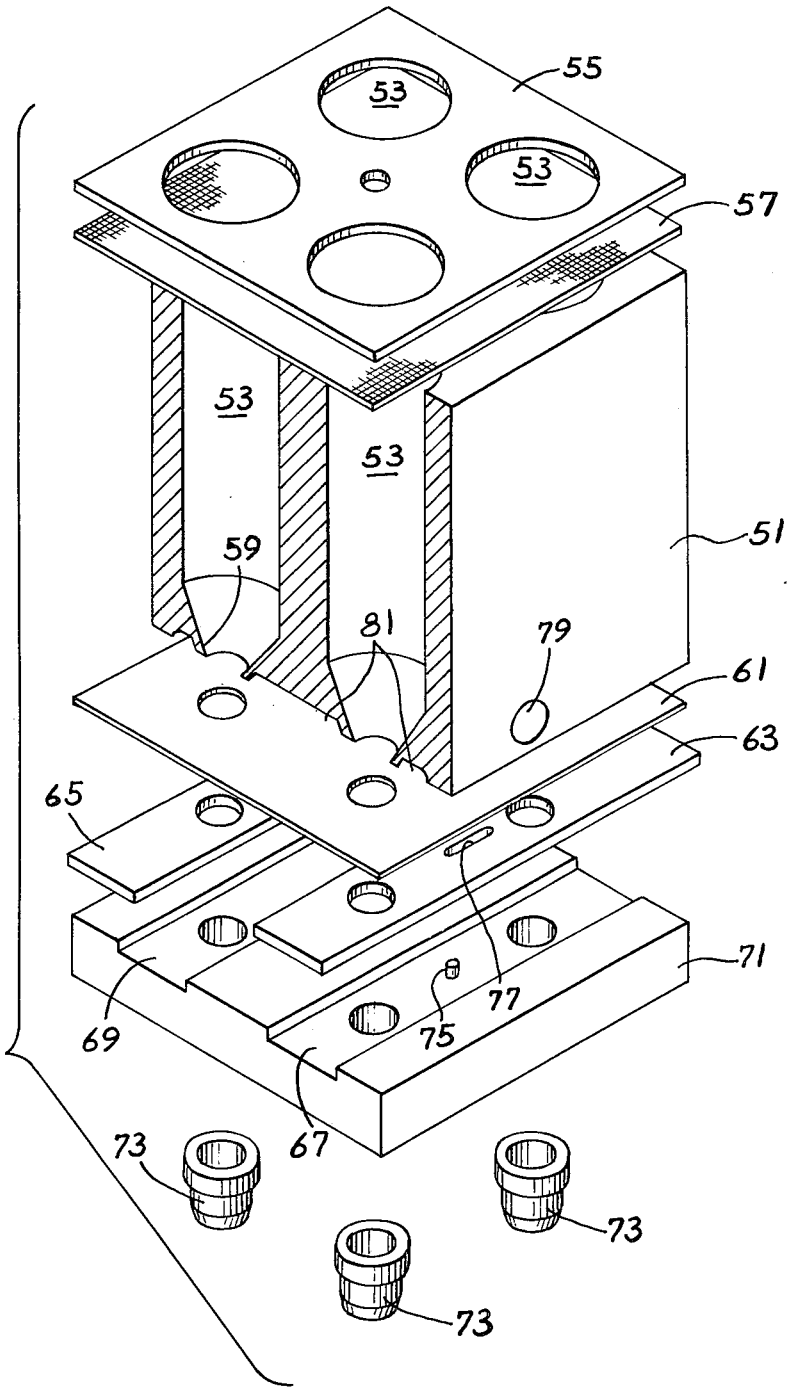
FIG. 6 is an exploded perspective view of a further embodiment of the invention.

Referring now to FIG. 6, a further embodiment of the invention is shown. FIG. 6 comprises a multichamber blending device in which a chamber housing 51 is provided with four chambers 53 therein. The device may also be provided with a top plate 55 and a screen 57 sandwiched between the top plate and the chamber housing 51.

The lower ends of each of the chambers are formed with a frustoconical section 59, the lower periphery of which terminates a short distance above the lowest level of the underside of the chamber housing 51. A diaphragm or shim plate 61 is located at the underside of the chamber housing 51, and sliding plates 63 and 65 are provided, each in one of two tracks 67 and 69, respectively, formed in a base or gate housing 71.

As was the case in the previous embodiment, the plates 63 and 65 are provided with holes which register with the holes in the diaphragm plate 61 and with the open lower end of the frustoconical section 59. Spouts 73 are provided in the base 71 at each of the openings therein for discharging the contents of the chambers. Positioning pins 75 extend upwardly in the track 67 to register in elongated slots 77 in the plates 63 for positioning the holes therein properly.

An air inlet opening 79 is provided in the chamber housing 51 to provide for the inlet of pressurized fluid to the plenum 81. The plenum 81 surrounds each of the chambers 53 at the lower ends thereof and is defined by the space between a recessed part of the lower surface of the chamber housing and the diaphragm or shim plate 61. By spacing the lower end of the frustoconical sections 59 of each chamber a sufficient distance above the lowermost surface of the housing 51 at the periphery of the underside, the necessary slits are defined to allow the 360° passage of air into the chambers 53.

Figure 7:
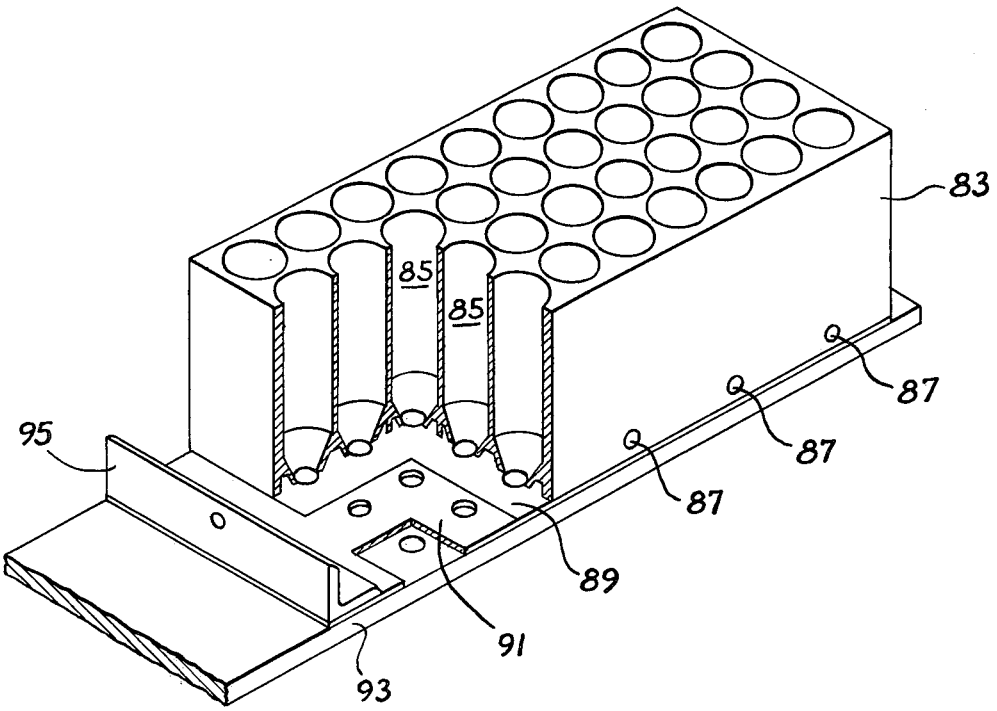
FIG. 7 is a perspective view, with parts broken out, of a still further embodiment of the invention.

Referring now to FIG. 7, a still further embodiment of the invention is shown. In this case, the chamber body or housing 83 defines a plurality of mixing chambers 85. The lower surface of the housing 83 is configured similarly to that of the housing 51 in the previously described embodiment. However, the plenums are each confined to groups of four mixing chambers, and separate air inlets 87 are provided to each of the plenums. A shim plate 89 is provided against the underside of the housing 83, and a sliding plate 91 with suitable registry holes therein is provided between the shim 89 and a base plate 93. An actuating bracket 95 is provided on the sliding plate 91 in order to move the sliding plate along the bracket and thus dump the contents of the mixing chambers 85.

In the device of the invention, both axial and radial homogeneity is readily achieved with components with large variations in particle density and size. The device is conveniently loaded and unloaded and therefore may be used in an automated production line. Transfer of the particles into and out of the blending chamber may be accomplished with a minimum of particle breakage and, with the embodiments of FIGS. 6 and 7, many small chambers may be blended simultaneously while dumping the contents directly into injection molds.

The foregoing results are provided by the use of an annular or 360° open slit at the bottom of each of the mixing chambers. Unloading is facilitated by a mechanical slide valve and multiple blending in very confined quarters is readily accomplished.

It may therefore be seen that the invention provides an improved blending device for mixing particulate material. The device has advantage especially in connection with particulate materials wherein the components are of widely varying size and density.

Various modifications of th invention in additionto shose shown and described herein will become apparent to those skilled in the art from the foregoing description and accompanying drawings. Such modifications are intended to fall within the scope of the appended claims.

What is claimed is:

1. A blending device for providing a uniform mix of particulate material, comprising, wall means defining a mixing chamber of substantially circular cross section on a substantially vertical axis and which has a tapered lower portion, said wall means having a lower end defining an opening, means for selectively opening and closing said opening, means defining a plenum surrounding said mixing chamber proximate said lower end thereof, an annular slit in said wall means at said lower end communicating between said plenum and said mixing chamber and having an axis coinciding with the axis of said chamber, and means for conducting pressurized fluid to said plenum to discharge through said slit for agitating particulate material contained in said mixing chamber, said slit having an orientation with respect to said chamber such that fluid discharging therethrough inwardly flows initially in a direction which is substantially perpendicular to the axis of said chamber and said slit.

2. A blending device according to claim 1 wherein said wall means include a cylindrical upper section, a frustoconical lower section, and a bottom plate, said frustoconical lower section terminating a distance from said bottom plate to define said slit.

3. A blending device according to claim 2 wherein said bottom plate is displaceable to allow the contents of said chamber to discharge through said frustoconical lower section.

4. A blending device according to claim 1 wherein the width of said slit is less than half the diameter of the smallest particle.

5. A blending device according to claim 1 including an annular wall of porous material in said slit.

6. A blending device according to claim 1 wherein said wall means define a plurality of mixing chambers, and wherein said plenum is common to each.

7. A blending device for providing a uniform mix of particulate material, comprising, wall means defining a mixing chamber and including a cylindrical upper section on a vertical axis and a frustoconical lower section terminating in a lower orifice, a slidable plate positioned perpendicular to the axis of said frustoconical lower section and spaced a distance therefrom to define a slit communicating with the interior of said mixing chamber at the bottom thereof, means defining with said slidable plate a plenum surrounding said frustoconical lower section, and means for conducting pressurized fluid to said plenum to discharge through said slit for agitating particulate material contained in said mixing chamber.

8. A blending device according to claim 7 wherein said slidable plate is provided with an opening therein for registering with said frustoconical lower section to discharge the contents of said mixing chamber.

9. A blending device for providing a uniform mix of particulate material, comprising, wall means defining a plurality of mixing chambers, each of said mixing chambers being of substantially circular cross section on a substantially vertical axis and having a tapered lower portion having a lower end defining an opening, means for selectively opening and closing said openings all at once, means defining a plenum surrounding each of said mixing chambers proximate said lower ends thereof, a plurality of annular slits in said wall means at said lower ends thereof, each communicating between said plenum and one of said mixing chambers and having an axis coinciding with the axes of said chamber and said slit, and means for conducting pressurized fluid to said plenum to discharge through said slits for agitating particulate material contained in said mixing chambers, each of said slits having an orientation with respect to said chamber such that fluid discharging therethrough inwardly flows initially in a direction which is substantially perpendicular to the axes of said chamber and said slit.

* * * * *

UNITED STATES PATENT AND TRADEMARK OFFICE

CERTIFICATE OF CORRECTION

PATENT NO. : 4,045,005

DATED : August 30, 1977

INVENTOR(S) : Dwight E. Davis, et al.

It is certified that error appears in the above-identified patent and that said Letters Patent are hereby corrected as shown below:

Column 1, line 31 "so" should be --or--.

Column 4, line 29 "additionto" should be --addition to--.

Column 4, line 29 "th" should be --the--.

Signed and Sealed this

*Tenth* Day of *January 1978*

[SEAL]

*Attest:*

RUTH C. MASON
*Attesting Officer*

LUTRELLE F. PARKER
*Acting Commissioner of Patents and Trademarks*